US006442767B1

(12) United States Patent
Meckes et al.

(10) Patent No.: US 6,442,767 B1
(45) Date of Patent: Sep. 3, 2002

(54) SAFETY HELMET

(75) Inventors: Rüdiger Meckes, Berkenthin; Purushotham Mahavadi, Stockelsdorf; Siegfried Zimprich, Wentorf, all of (DE)

(73) Assignee: Dräger Aerospace GmbH (DE)

( * ) Notice: Subject to any disclaimer, the term of this patent is extended or adjusted under 35 U.S.C. 154(b) by 0 days.

(21) Appl. No.: 09/482,388

(22) Filed: Jan. 12, 2000

Related U.S. Application Data

(63) Continuation-in-part of application No. 09/075,971, filed on May 11, 1998, now abandoned.

(30) Foreign Application Priority Data

Aug. 16, 1997 (DE) ..... 197 35 553

(51) Int. Cl.[7] ..... A42B 1/08
(52) U.S. Cl. ..... 2/424; 2/6.4; 2/10; 2/422
(58) Field of Search ..... 2/410, 411, 422, 2/424, 10, 6.3, 6.4, 6.5, 6.7; 128/201.24, 207.11, 206.23, 206.24

(56) References Cited

U.S. PATENT DOCUMENTS 4,352,353 A * 10/1982 Bolton et al. ..... 128/201.24
4,589,172 A * 5/1986 Hoenigs et al. ..... 24/602
5,291,880 A * 3/1994 Almovist et al. ..... 128/201.22
5,555,569 A * 9/1996 Lane ..... 2/424

FOREIGN PATENT DOCUMENTS

DE 9490294 * 11/1996
FR 2637808 * 4/1990

* cited by examiner

*Primary Examiner*—Rodney M. Lindsey
(74) *Attorney, Agent, or Firm*—McGlew and Tuttle, P.C.

(57) ABSTRACT

A safety helmet combined with a visor (3) in a detachable connection, which is formed by holding structure located on both sides at the safety helmet shell (2). Wear properties are improved by the holding structure having rigid coupling hooks (10), which are connected to the visor (3), catch openings (11) receiving the coupling hooks (10), and hinges. A visor structure (13) that can be pivoted over the visor (3) is fastened to the hinges (12); and the detachable connection is designed such that the visor structure (13) is connected to the visor (3) in one assembly unit with it when the visor (3) is removed from the safety helmet (1).

20 Claims, 4 Drawing Sheets

3
13
2
32
35
34
29
11
30
12
33
14B
14A
14

SAFETY HELMET

RELATED APPLICATIONS

This is a CIP of application Ser. No. 09/075,971 filed May 11, 1998, now abandoned, and the entire disclosure of this prior application is considered to be part of the disclosure of the accompanying application and is hereby incorporated by reference therein.

FIELD OF THE INVENTION

The invention relates generally to safety apparel and more particularly to a safety helmet with visor and with a respirator half mask for protection of persons who have to work within closed, nonventilated spaces against an ambient atmosphere containing harmful substances.

BACKGROUND OF THE INVENTION

A safety helmet with a removable visor has become known from U.S. Pat. No. 4,315,335. The prior-art safety helmet offers protection to persons who have to work within closed, nonventilated spaces against the ambient atmosphere containing harmful substances. Circumferential sealing edges, which are designed corresponding to one another, are provided at both the safety helmet shell and at the visor to seal the interior space of the safety helmet against the ambient atmosphere. To fasten the visor to the helmet shell, two flexible straps are arranged on the side at the visor, and these flaps are buttoned into fastening points at the safety helmet shell. The prior-art safety helmet is provided with breathing pressure-controlled control valves connected to a gas source, via which breathing gas is supplied to the user of the safety helmet.

It is necessary for certain types of work to arrange auxiliary means, e.g., a pivotable visor means, at the safety helmet. In prior-art safety helmets, the visor means is fastened to the safety helmet shell by means of two hinges. Such a safety helmet is shown in DE 27 21 727 C2. However, the fastening of the visor means shown in the prior-art safety helmet is impractical for safety helmets with a removable visor, because, e.g., a lowered visor means hinders the removal of the visor.

SUMMARY AND OBJECTS OF THE INVENTION

The primary object of the present invention is to improve a safety helmet of the above-described type in terms of its wear properties.

According to the invention, a safety helmet combined with a visor is provided with a detachable connection. The connection is formed by holding means located on both sides at the safety helmet shell. The holding means comprises rigid coupling hooks, which are connected to the visor, catch openings, which are located in the cheek area of the safety helmet shell and receive the coupling hooks, and hinges. A visor means or auxiliary visor is pivotable over the visor and is fastened to the hinges. The detachable connection is designed such that the visor means is connected to the visor as one assembly unit with the visor removed from the safety helmet.

The advantage of the present invention is essentially that the visor means is connected via the hinge forming an assembly unit with the visor, so that the visor can be removed from the safety helmet shell together with the visor means when the connection between the visor and the safety helmet shell is severed.

A respirator half mask, which is fastened within an opening in the visor by means of a flexible component, is advantageously provided for supplying the user of the safety helmet with breathing gas. The flexible component makes possible a lifting movement of the respirator half mask in relation to the visor in order to better adapt it to the contours of the faces of different helmet users. A so-called bellows, with which a broad range of movement can be covered, is especially suitable as a flexible component.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
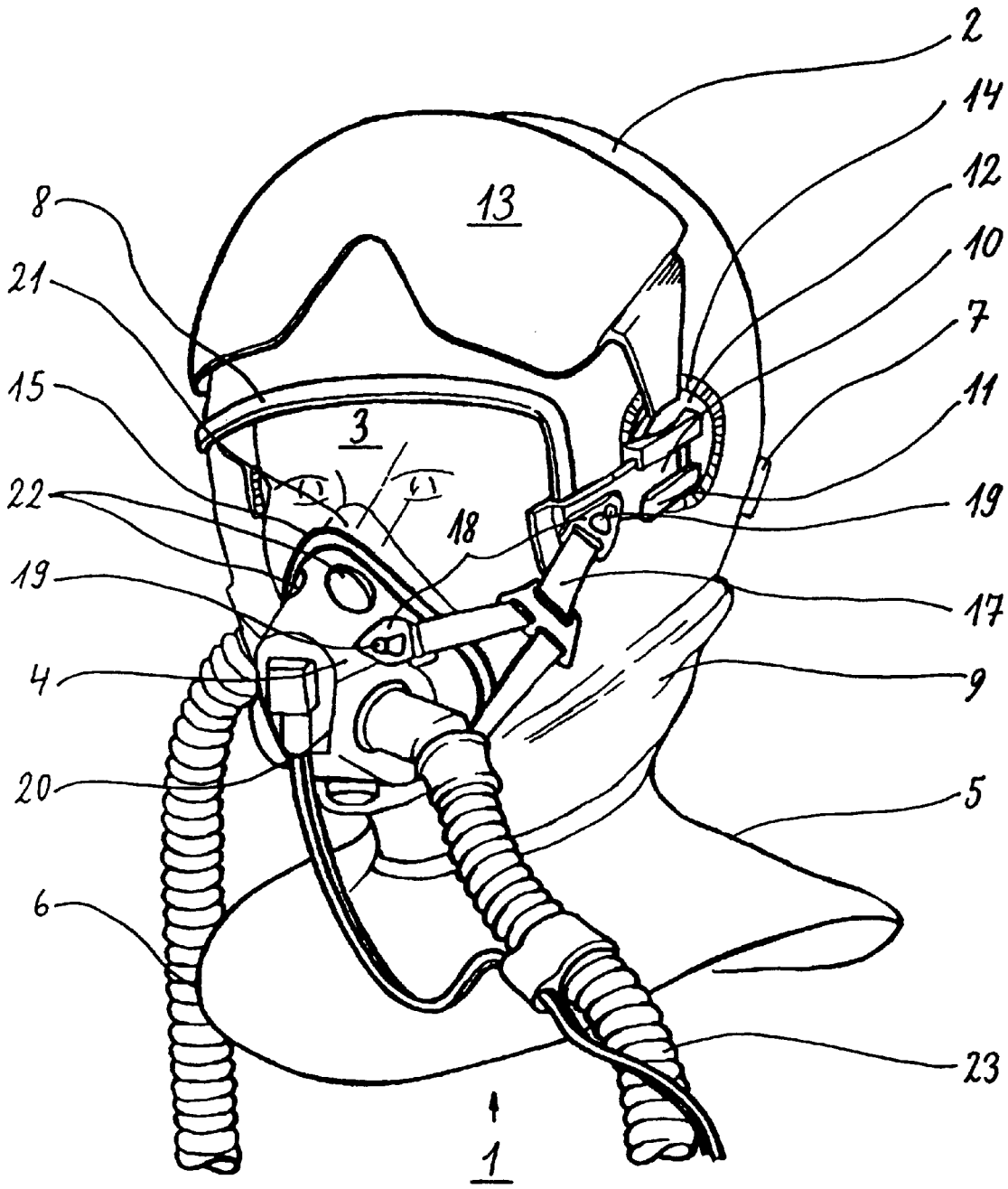
FIG. 1 is a front perspective view of a safety helmet according to the present invention.

Referring to the drawings in particular, FIG. 1 shows a safety helmet 1, which is designed as a pilot helmet with integrated ABC (Atomic, Biological, and Chemical) protection. The safety helmet comprises a safety helmet shell 2, a main visor 3 with a respirator half mask 4, and a ruff 5, which is fastened on the underside of the safety helmet shell 2 in a circumferential groove 9 and lies on the shoulders of a helmet user, not shown in FIG. 1. Good sealing of the safety helmet 1 against the environment shall be achieved with the ruff 5. A supply tube 6 is connected laterally to the safety helmet shell 2. The supply tube 6 supplies filtered fresh air from a blower, not shown in FIG. 1, into the interior space of the safety helmet shell 2 to generate a predetermined overpressure. As a result, harmful gases are prevented from penetrating into the safety helmet shell 2 from the environment. The fresh air is led past the visor 3 and can flow off into the environment via a control valve 7 on the rear side of the safety helmet shell 2.

Figure 5:
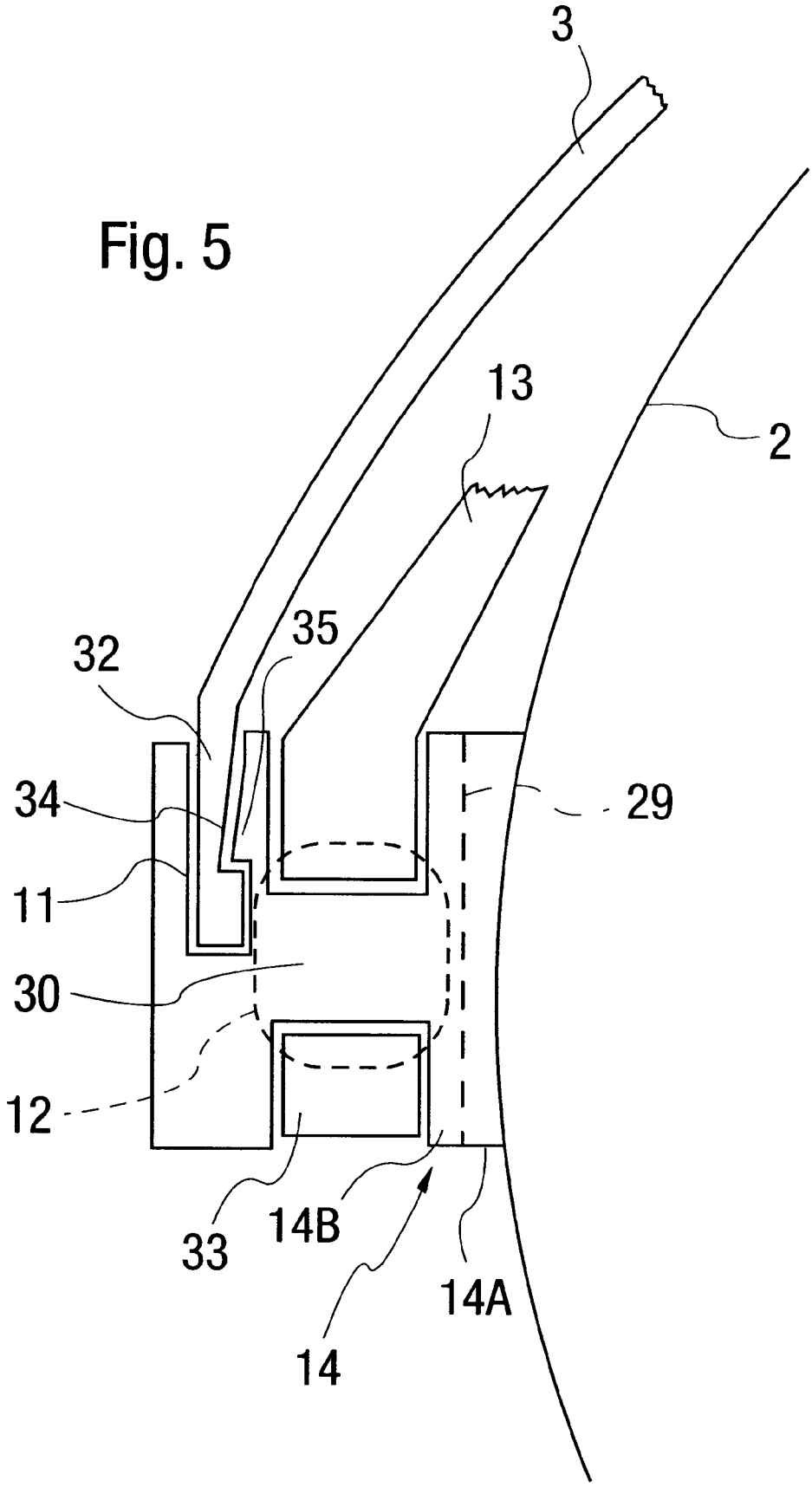
FIG. 5 is a close up view of another embodiment of a visor connection to the helmet shell.

To seal the visor 3 against the safety helmet shell 2, a circumferential sealing bead 8 is provided in the connection area between the visor 3 and the safety helmet shell 2. Catches are positioned on the right and left sides of the shell 2. Each catch defines a catch opening 11. Coupling hooks 10 have one end connected to the visor 3 at the right and left lateral side areas of the visor 3. The other end of the coupling hooks 10 form a tongue 32 which fits into the catch opening 11 of the catches. The tongues 32 of the coupling hooks 10, which are pushed into corresponding catch openings 11 on the safety helmet shell 2 and are locked there by teeth 31. Only the coupling hooks 10 and the catch opening 11 on the left-hand side of the helmet are shown in FIG. 1 for the sake of greater clarity. A clamp 28 is connected to the catch opening 11 by a bolt 27. The clamp 28 is in turn connected to the helmet shell 2 by a connection shaft 30 and water sensitive locking components 14. In the embodiment of FIG. 5, the tongue defines a recess 34 for receiving a tooth of the catch opening 11.

A visor means or auxiliary visor 13 can be pivoted over the main visor 3 by hinges 12. The hinges 12 are located at the catch openings 11, on both sides of the safety helmet shell 2 and pivot the auxiliary visor 13 between a raised and lowered position. The hinges 12 include a ring 33 pivotal around the connection shaft 30 of the catch openings 11.

Water-sensitive locking components 14 sever both the connection between the hinges 12 and the safety helmet shell 2, and between catch openings 11 and the helmet shell 2, in the case of landing on water. This causes the main visor 3 to be thrown off from the safety helmet shell 2 together with the auxiliary visor 13. The water-sensitive locking components 14 have a first part 14A and a second part 14B arranged between the hinges 12 and the safety helmet shell 2. First part 14A is attached to the helmet shell 2 and the second part 14B is attached to the connection shaft 30. First and second parts 14A, 14B are connected to each other during normal conditions along an interface 29, but the interface 29 separates during contact with water. Such water-sensitive locking components are known from U.S. Pat. No. 4,589,172 which is hereby incorporated by reference. Since the respirator half mask 4 is connected to the visor 3, the half mask is removed from the face of the helmet user together with the visor 3.

The positive pressure breathing of the helmet user, not shown in FIG. 1, at breathing pressures greater than 50 mbar imposes high requirements in terms of strength on the arrangement of the respirator half mask 4 at the main visor 3. The respirator half mask 4 is fastened for this purpose within an opening 15 in the main visor 3 by means of a bellows 16, which allows relative movement of the respirator half mask 4 in relation to the main visor 3. The respirator half mask 4 is tensioned in relation to the main visor 3 or to the face of the helmet user, not shown in FIG. 1, by means of a band 17. The band 17 has straps or connectors 18, which can be buttoned into fastening cams 19 at the respirator half mask 4 and at the coupling hook 10.

The respirator half mask 4 comprises a rigid molding 20. A flexible mask 21 for contact with the face of the helmet user is placed in the rigid molding 20. The fastening cams 19, as well as the bellows 16 are arranged at the molding 20. Access openings 22 are present as a means for Valsalva maneuver in the nose area of the molding 20. The positive pressure breathing of the helmet user takes place via a breathing tube 23 connected to the respirator half mask.

Figure 2:
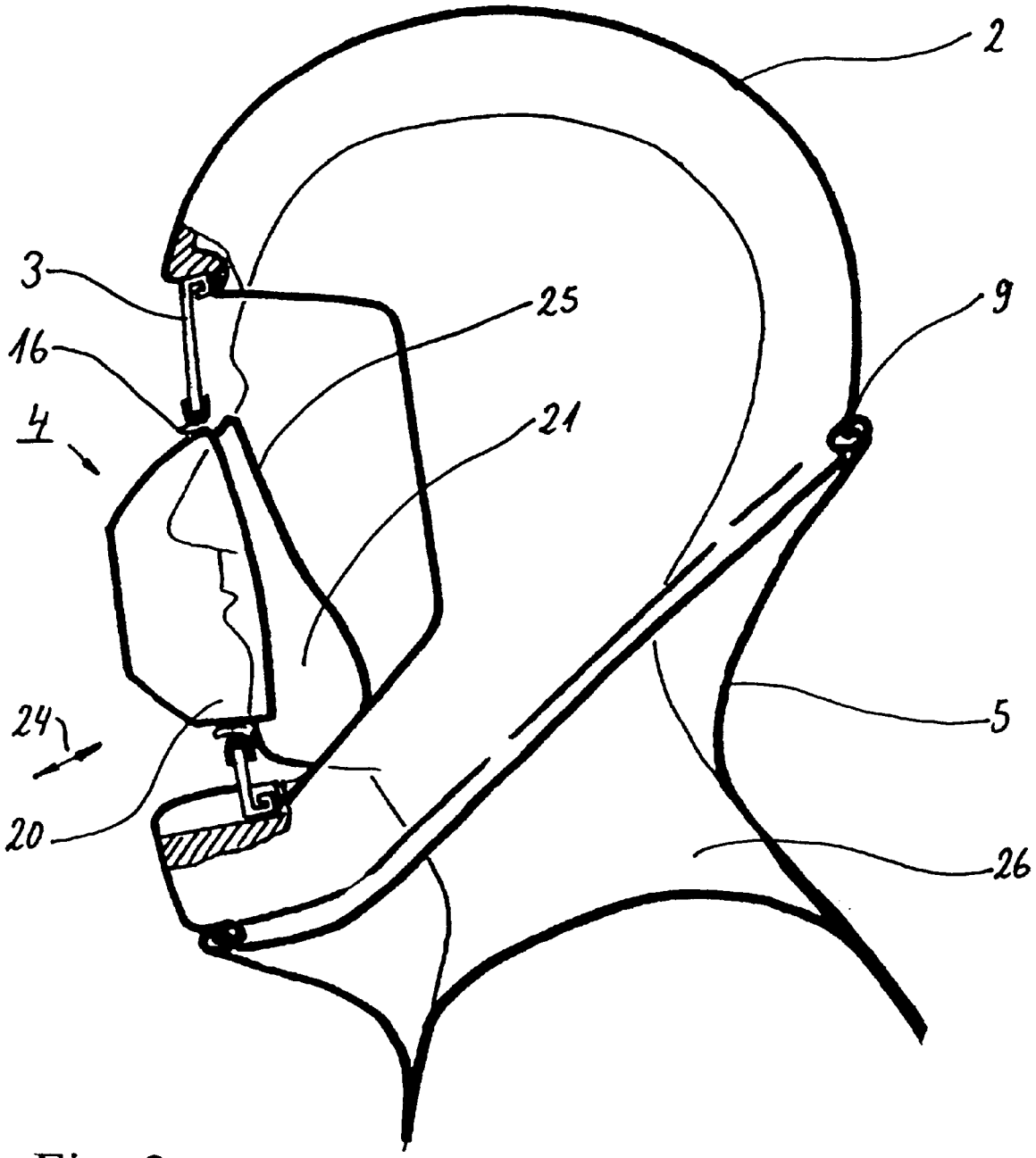
FIG. 2 is a longitudinal sectional view taken through the safety helmet according to FIG. 1.
Figure 3:
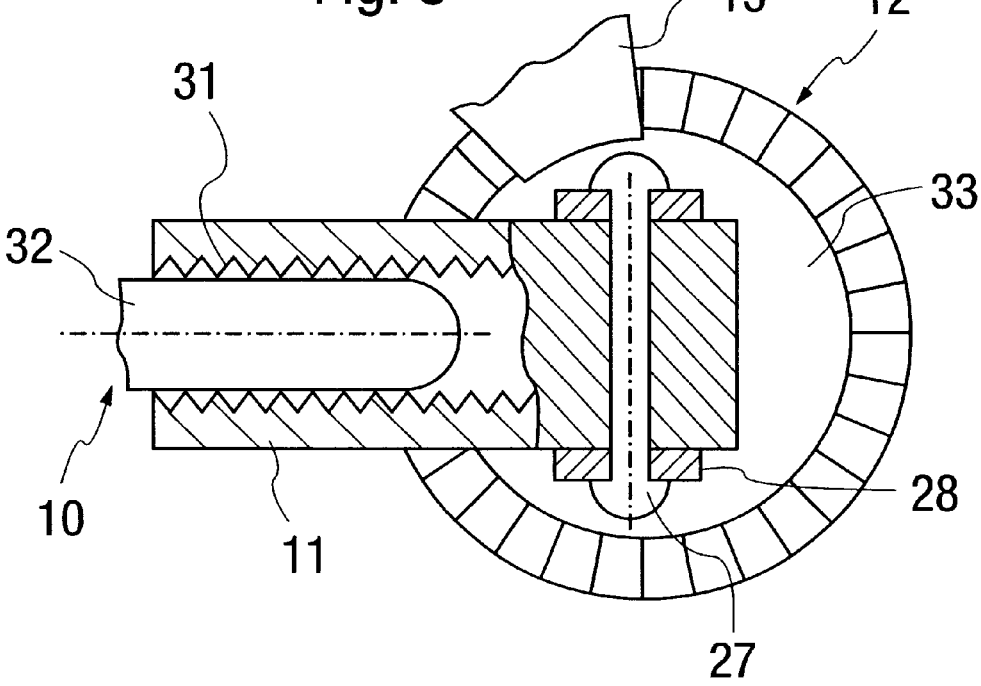
FIG. 3 is a close up view of a visor connection to the helmet shell
Figure 4:
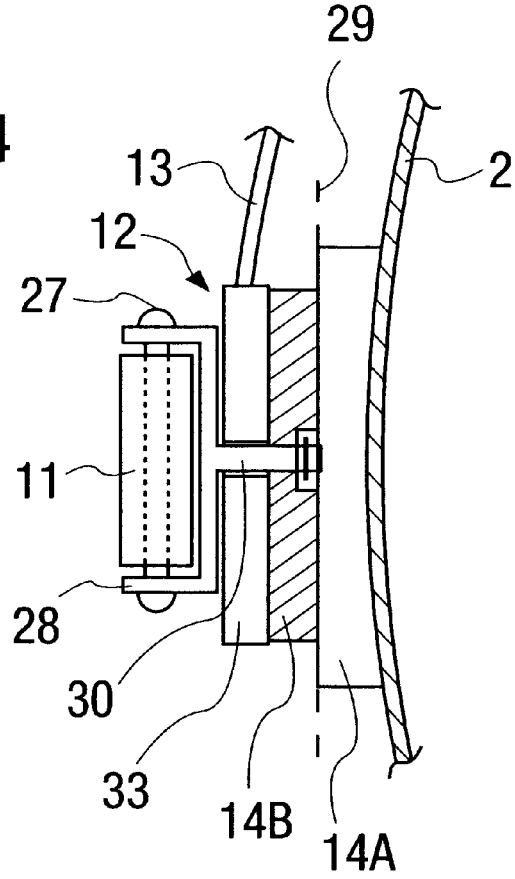
FIG. 4 is a cross sectional view of the visor connection s to the helmet shell.

FIG. 2 schematically illustrates a side view of the longitudinal section of the safety helmet 1 according to FIG. 1. Identical components are designated with the same reference numbers as in FIG. 1. A lifting movement of the respirator half mask 4 along the arrow 24 is possible by means of the bellows 16, as a result of which an especially good adaptation of the mask 21 to the face contour 25 of the helmet user is achieved. The good adaptability of the respirator half mask 4 to the face contour 25 of the helmet user 26 is based on the fact that uncoupling of the otherwise rigid safety helmet shell 2 from the respirator half mask 4 is achieved due to the flexibility of the bellows 16.

While a specific embodiment of the invention has been shown and described in detail to illustrate the application of the principles of the invention, it will be understood that the invention may be embodied otherwise without departing from such principles.

What is claimed is:

1. A safety helmet comprising:

a helmet shell;

a visor;

a visor detachable connection formed by holding means located on both of two sides of said safety helmet shell, said holding means including rigid coupling hooks connected to said visor, catch opening located in a cheek area of the safety helmet shell receive said coupling hooks, and hinges;

visor means pivotable over said visor, said visor means being fastened to said hinges externally of said safety helmet shell, said visor detachable connection connecting said visor means to said visor as one assembly unit for removal of said visor means with said visor from said safety helmet.

2. The safety helmet in accordance with claim 1, further comprising a respirator half mask wherein said visor has an opening for fastening said respirator half mask.

3. The safety helmet in accordance with claim 2, further comprising a flexible component, which makes possible a lifting movement between said respirator half mask and said visor, is provided in a connection area between said opening and said respirator half mask.

4. The safety helmet in accordance with claim 3, wherein said flexible component is a bellows.

5. The safety helmet in accordance with claim 1, wherein said detachable connection includes a water-sensitive locking component.

6. The safety helmet in accordance with claims 2, wherein said respirator half mask is fastened to said coupling hook with a band.

7. The safety helmet in accordance with claim 5, wherein said, water-sensitive locking component is arranged between said hinges and said safety helmet shell.

8. A safety helmet, comprising:

a helmet shell;

a main visor;

a visor detachable connection on said helmet shell and connecting said main visor with said helmet shell, said visor detachable connection including rigid coupling hooks connected to said main visor, and catch openings located in a cheek area of said helmet shell, said catch openings receive said coupling hooks;

an auxiliary visor pivotally connected to said visor detachable connection by a hinge, said hinge connecting said auxiliary visor externally of said safety helmet shell and to said main visor as one assembly unit for removal of said auxiliary visor with said main visor from said helmet shell as said one assembly unit.

9. The safety helmet in accordance with claim 8, further comprising:

a respirator half mask wherein said main visor defines an opening for receiving said respirator half mask.

10. The safety helmet in accordance with claim 9, further comprising:

a flexible component in a connection area between said opening and said respirator half mask movably connecting said respirator half mask to said main visor.

11. The safety helmet in accordance with claim 10, wherein:

said flexible component is a bellows movably connecting said respirator half mask and said main visor in a direction to lift said respirator half mask away from a face of a user.

12. The safety helmet in accordance with claim 8, wherein:

said detachable connection includes a water-sensitive locking component.

13. The safety helmet in accordance with claims 9, wherein:

said respirator half mask is fastened to said coupling hook with a band.

14. The safety helmet in accordance with claim 12, wherein:

said water-sensitive locking component is arranged between said hinge and said helmet shell.

15. The safety helmet in accordance with claim 8, wherein:

said visor detachable connection seals said main visor to said helmet shell.

16. The safety helmet in accordance with claim 8, wherein:

said holding means rigidly connects said main visor to said helmet shell.

17. The safety helmet in accordance with claim 8, wherein:

said rigid coupling hooks are directly connected to said main visor.

18. The safety helmet in accordance with claim 1, wherein:

said holding means rigidly connects said visor to said helmet shell.

19. The safety helmet in accordance with claim 1, wherein:

said visor detachable connection seals said visor to said helmet shell.

20. A safety helmet, comprising:

a helmet shell;

a main visor;

a visor detachable connection on said helmet shell and connecting said main visor with said helmet shell, said visor detachable connection including rigid coupling hooks connected to said visor, and catch openings located in a cheek area of said helmet shell, said catch openings receive said coupling hooks an auxiliary visor pivotally connected to said visor detachable connection by a hinge, said hinge connecting said auxiliary visor to said main visor as one assembly unit for removal of said auxiliary visor with said main visor from said helmet shell;

a respirator half mask wherein said main visor defines an opening for receiving said respirator half mask;

a flexible component in a connection area between said opening and said respirator half mask movably connecting said respirator half mask to said main visor.

* * * * *